US006966553B2

(12) United States Patent
Rathert

(10) Patent No.: US 6,966,553 B2
(45) Date of Patent: Nov. 22, 2005

(54) DEVICE FOR PREPARING ADHESIVE BINDINGS OF BLOCKS AND BROCHURES, ESPECIALLY FOR SMALL PRINT RUNS

(76) Inventor: Horst Rathert, Stiftsalle 120, D-32425, Minden (DE)

( * ) Notice: Subject to any disclaimer, the term of this patent is extended or adjusted under 35 U.S.C. 154(b) by 0 days.

(21) Appl. No.: 10/385,537

(22) Filed: Mar. 11, 2003

(65) Prior Publication Data

US 2003/0185654 A1 Oct. 2, 2003

(30) Foreign Application Priority Data

Mar. 12, 2002 (DE) ..... 102 10 843

(51) Int. Cl.[7] ..... B42C 5/00
(52) U.S. Cl. ..... 270/52.18; 270/58.08; 412/28; 412/25; 412/9
(58) Field of Search ..... 270/52.18, 58.07, 270/58.08; 412/8, 37, 25, 9, 13, 28; 118/503

(56) References Cited

U.S. PATENT DOCUMENTS 2,163,812 A * 6/1939 Schramm ..... 412/8
2,572,243 A * 10/1951 Cashin et al. ..... 412/8
2,605,739 A * 8/1952 De Florez ..... 412/37
3,594,837 A * 7/1971 French ..... 412/16
4,237,569 A * 12/1980 Muller ..... 412/16
4,524,857 A * 6/1985 Rathert et al. ..... 198/409
4,904,138 A * 2/1990 Champeaux et al. ..... 412/8
5,318,398 A * 6/1994 Kojima ..... 412/18
5,632,587 A * 5/1997 Coyette ..... 412/11
5,941,671 A * 8/1999 Wehrle ..... 412/8
6,099,224 A * 8/2000 Uchida et al. ..... 412/9
6,503,040 B1 * 1/2003 Abegglen et al. ..... 412/37
6,575,445 B1 * 6/2003 Garlichs et al. ..... 270/52.18
6,685,416 B2 * 2/2004 Itoh et al. ..... 412/37

* cited by examiner

*Primary Examiner*—Patrick Mackey
(74) *Attorney, Agent, or Firm*—McGlew and Tuttle, P.C.

(57) ABSTRACT

The present invention pertains to a device of compact design for preparing adhesive bindings of blocks and brochures as well as to a process that can be carried out by means of a device according to the present invention, wherein it has a linear conveying system with clamping rails moving to and fro, whereby the blocks are conveyed in at least two steps.

Figure 1:
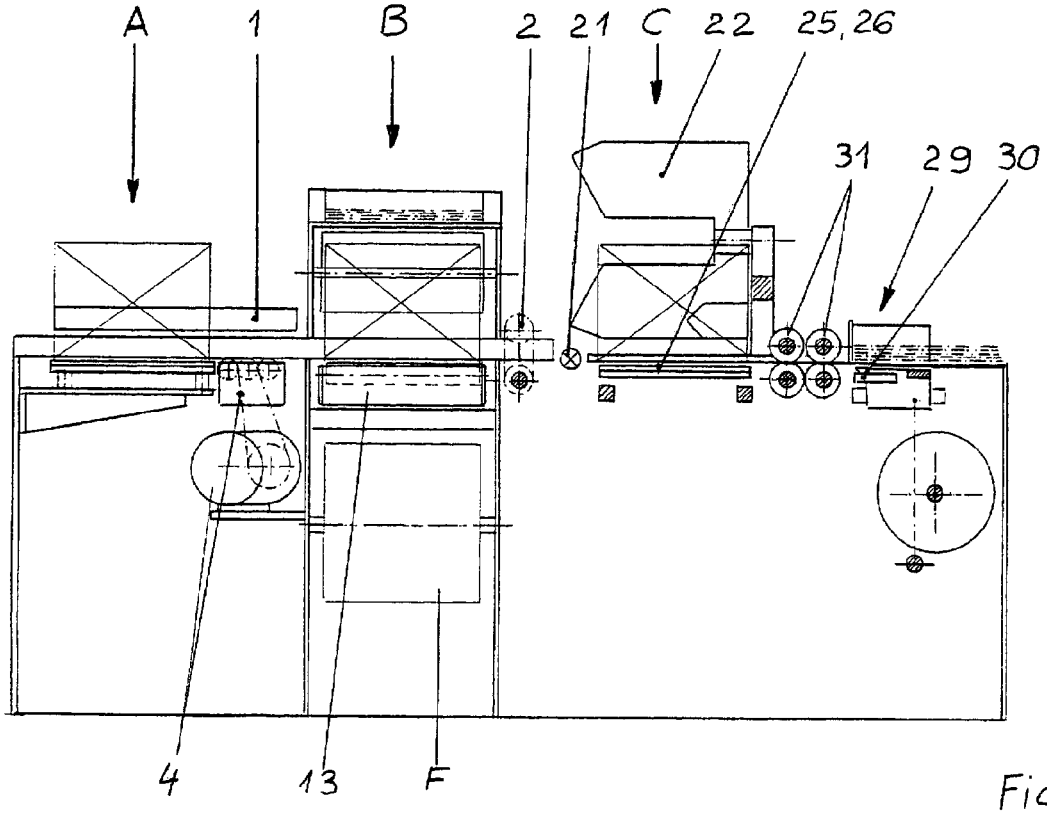

Processing operations are performed on the block during the resulting phases of movement and stop phases.

The clamping rails have different shapes at the contact surface toward the block depending on the requirement of the stations fed by them.

The complete unit makes possible the universal production of commemorative volumes, brochures and folded brochures and comprises for this purpose the application of end papers, the folding and the application of covers. The end papers are fed flush to the finished spine after the processing of the spine. The gluing of the block spines is carried out at right angles to the height of the block during the stopping of the block by a lifting movement of the gluing mechanism. The feeding of slip-fold strips is coupled with the lifting movement of the gluing mechanism. The delivery is carried out gently by means of a rotatable system of clamping stations.

20 Claims, 4 Drawing Sheets

DEVICE FOR PREPARING ADHESIVE BINDINGS OF BLOCKS AND BROCHURES, ESPECIALLY FOR SMALL PRINT RUNS

The present invention pertains to a device for preparing adhesive bindings of blocks and brochures, especially for small print runs, as well as to a process for preparing adhesive bindings of blocks and brochures, especially for small print runs, according to.

Within the framework of the production of brochures, stacks collated before are processed on the spine by milling in the case of adhesive bindings, subsequently coated with glue and then hung into a cover. The cover is now firmly bonded to the spine of the block.

In certain special types of brochures, the cohesion of the sheets is achieved by means of a slip-fold strip, which is firmly bonded to the spine and is also glued on the side to the first and last sheets of the block. The cover is glued to the block in a linear pattern only on the side, on one side or on both sides, in the vicinity of the spine. Many different types of devices have been known for this type of production. The feature common to all solutions is that a slip-fold strip and then the cover are placed on the spine.

To prepare adhesive-bound blocks for hardcover books, the block must be provided with an end paper each in the front and back corresponding to the manner common in bookbinding. The spine is often not processed in the case of, e.g., thread-stitched blocks, thread sealing or perforation binding. The spine is always coated with glue and then folded.

Devices for preparing adhesive binding, which can perform all the operations described, are commonly used in the bookbinding industry. However, these are always machines operating according to complicated principles, which cannot be used economically for small print runs.

The feeding of front and back end papers is always problematic in all these machines when the spine of the block shall be milled during the adhesive binding. The reasons for this are as follows:

The end papers are usually introduced into the feed conveying mechanism in front of the conveying system of the adhesive binding device proper. Because of the milling off on the spine, the end papers are fed in an elevated position by the amount milled off compared with the spine, coated with glue in a linear pattern, and pressed onto the block. Contamination with glue and skew bonding of the end papers are often brought about by this procedure.

The end papers must be attached higher by a certain tolerance because of the possible binding differences in order not to be cut during milling.

Therefore, they are not located exactly at the level of the spine after the milling and therefore they also cannot be connected intensely to the spine of the block by means of the spine glue.

If a folding station shall be provided in a device for preparing blocks and folded brochures, this results in a very long adhesive binding device.

If the placement of end papers is possible, the length of the feed area of the adhesive binding device and consequently the overall length of the unit increase considerably. This is completely unacceptable especially in the case of small print runs.

Another weak point of prior-art devices of the type mentioned is generally also the delivery device, especially in the case of compact adhesive binding units, because the blocks freshly coated with glue on the spine often fall out of the conveying system and onto a chute, with which they are brought into the horizontal position from the vertical position. In other designs, they are deposited on a longitudinal conveying system, on which they are conveyed in a helical pattern into the horizontal position. The fresh blocks are now diagonally distorted and the spine glue is correspondingly stressed.

To avoid the disadvantages in terms of quality in the products, a cross stack delivery device, in which the blocks are pushed out at right angles to the direction of conveying, is therefore often used in low-speed adhesive binding devices, so that the blocks are stacked standing on their spines next to one another. However, this delivery does not permit an in-line coupling with a downstream machine or drying section.

Another problem of the adhesive binding delivery device during the processing of brochures and especially of brochures with flaps taken up on the cover is the release from the clamping system after the pressing on of the cover, because the opening clamp will again tear open the lateral bonding of the cover with the block and the outer sheets are displaced in milled blocks when the clamp is again lowered.

In another design, the opening of the bond is prevented by the transfer of the block into clamp carriages, which hold the block together laterally in the area of the side gluing. However, sharp bends are frequently formed now in the cover close to the spine in the case of thicker cover materials.

Based on the state of the art described, the basic object of the present invention is to make possible the qualitatively better and more economical processing of commemorative volumes, brochures and folded brochures in the case of smaller print runs.

This object is accomplished by a device for preparing adhesive bindings of blocks and brochures, especially for small print runs, with a conveying device provided with clamping rails for fixing the blocks or brochures for moving the blocks or stacks of paper to be bound through the device, a processing unit for preparing a straight block spine, a gluing station for applying glue to the spines of the blocks or stacks of paper, and a delivery device for removing the completely glued blocks or stacks of paper, characterized in that the conveying device has a separate holding means for fixing the block or stack of paper being processed in the gluing station during the return of the clamping rails into the pick-up position for a new block or stack of paper and by a process for preparing adhesive bindings of blocks and brochures, especially for small print runs, with a device, in which the blocks and brochures are guided through the device by means of a conveying device provided with clamping rails for fixing the blocks and brochures, wherein a straight block spine is first prepared in a processing unit, after which glue is applied to the spines of the blocks or brochures in a gluing station, and after the completion of the gluing, the completely glued blocks or stacks of paper are discharged, characterized in that the conveying through the device takes place in at least two steps by a forward and return movement of the clamping rails clamping the blocks laterally on the left and right when viewed in the direction of conveying, the blocks are taken over by a separate holding means during the return conveying stroke of the said clamping rails and pass through a conveying stop phase, during which the gluing on the spine of the book takes place, and that processing operations are carried out on the block both during the movement and during the stop, and special variants of the present invention as described below.

The device according to the present invention is a linearly arranged system with block conveying proceeding forward stepwise through a conveying device performing alternating movement. Two opposite clamping rails, which belong to the conveying device and are guided in a suitable manner, clamp the blocks or stacks of paper by an opening and closing movement.

The individual blocks are conveyed through the processing stations of the device in at least two steps, and a certain area of the clamping rails is always associated with the corresponding processing station and can therefore be adapted in terms of its shape. During the return movement of the clamping rails, the blocks are held according to the present invention in the position reached by an additional holding device. At least two phases of movement and at least two stop phases are thus formed during the conveying of a block.

Processing operations are performed on the block during both the phases of movement and the stop phases.

The blocks fed in automatically or inserted manually are clamped in the inserted position by the clamping rails, conveyed in the first step over the spine processing unit and into the first stop position, in which the end papers are applied, slip-fold strips are optionally fed in, and the gluing of the spine is carried out, while the clamping rails return into their starting position.

The area of the clamping rails that clamps the block for the first step may be designed for the conveying over the milling mechanism such that the block has only a small overhang. An optimally straight milling surface is obtained as a result. The small overhang does not interfere with the side gluing and the pressing on of slip-fold strips and the cover, as it would do in usual adhesive binding devices, because the part of the clamping rails thus designed is not engaged during these processing operations.

The block is held by a holding device in the first stop position, while the block conveying device is again returning into its starting position. This holding device is coordinated by the design with the operations taking place in this position.

According to the present invention, the end papers are fed in only in this position in the known manner by means of rotary feed units, after the spine of the block has already been milled off. They are now aligned by a stop plate under the spine of the block exactly flush with the spine of the block.

Incorrect positioning, milling of the end paper and linear auxiliary gluing are thus ruled out. The end papers are bound completely into the spine glue. Better quality is achieved as a result with a simplified process.

The coating of the spine with glue is carried out by a gluing roller moved to and fro by a gluing stroke under the spine at right angles to the direction of conveying. The thickness of the glue film applied is determined by a scraper. The glue pan is somewhat lowered during the return stroke in order to prevent the contact of the gluing roller with the spine of the block, which has possibly been provided meanwhile with a slip-fold strip. The scraper, which determines the thickness of the glue film applied, is now released. Contamination of the scraper with glue is flushed away by the gluing roller rotating backward.

The application and removal of the glue film at the head and foot of the block can now be achieved by means of simple scrapers on the gluing roller. The gluing boundary on the spine of the block can be made much more accurate than in the case of gluing in the direction of conveying with cyclically controlled scrapers, as is known from the state of the art. The relatively slow movement of the gluing roller prevents the build-up of an undefined static pressure, which may lead to the inflow of glue into the block.

Contamination on the glue scraper, which generates a narrow glue-free track on the gluing roller, does not lead to the non-bonding of sheets and to interruption of the spine glue in the direction of stressing, unlike in the case of longitudinal gluing.

A double roller may also be arranged in the glue pan for gluing with hot melt adhesives, in which case each of the two rollers can apply a glue film of different thickness.

If the folding operation is not carried out, twofold gluing can also be achieved by the forward and return stroke of one gluing roller by applying, e.g., a thin glue film with close contact with the spine of the block during the forward stroke and a thick glue film with a greater distance between the gluing roller and the spine of the block during the return stroke. The lowering movement of the gluing mechanism during the return stroke is limited to generate the distance between the gluing roller and the spine of the block.

The application of the slip-fold strip is coupled with the spine gluing in terms of movement. A suction plate pivotable with the gluing mechanism takes up the slip-fold strip cut to the desired length and presses it onto the spine surface of the block at the end of the gluing stroke. The slip-fold material is fed in as is usually done in the case of transverse folding. Arriving from the roll, the web material is driven by rollers and forwarded by a certain amount corresponding to the width of the slip-fold strip, fed to a cross-cutting means and cut there. The slip-fold strip to be cut off is already fixed by the suction plate during the cutting.

In the next step, the block is again grasped by the clamping rails of the conveying device, conveyed into the second stop position via the side gluing unit, and transferred there into a starshaped delivery unit which can be rotated stepwise.

The block is now clamped only by another area of the clamping rails, where the side gluing is not hindered and place is created for the cover during pressing on by a corresponding design.

The star-shaped delivery unit with block clamps arranged in a star-shaped pattern takes over the block for pressing on the cover and the slip-fold strip.

The cover is pressed on in the usual manner first on the spine and then on the sides. The pressing on the sides finally takes place when the clamping rails have left the pressing-on area during the return stroke and the cover can thus come into contact with the block without bending sharply and the lateral bonding is not torn up again after the releasing of the lateral pressing rails.

The block with the cover is pivoted out of the feed area of the conveying device by a pivoting step of the star-shaped delivery unit and is brought into a nearly horizontal position from the vertical position. The new block can meanwhile be fed in. The deposited block is released by the discharge clamp of the star-shaped delivery unit and brought onto a discharge conveyor, where it is moved on with the spine facing forward and an in-line coupling with downstream machines can be established. The delivery device is arranged at an ergonomically favorable level for manual removal.

The clamped deposition of the individual block spares the fresh spine gluing and prevents cracks in the glue film and deformations of the block.

The cover is fed in from the opposite direction, so that the paths of the block and cover do not cross and intersect up to the collation position for reasons of accessibility and clarity. The covers can likewise be fed at an ergonomically favorable level.

During the stopping of the individual block, the cover is aligned accurately with the position of the block, as a result of which high accuracy of position can be achieved.

Figure 2:
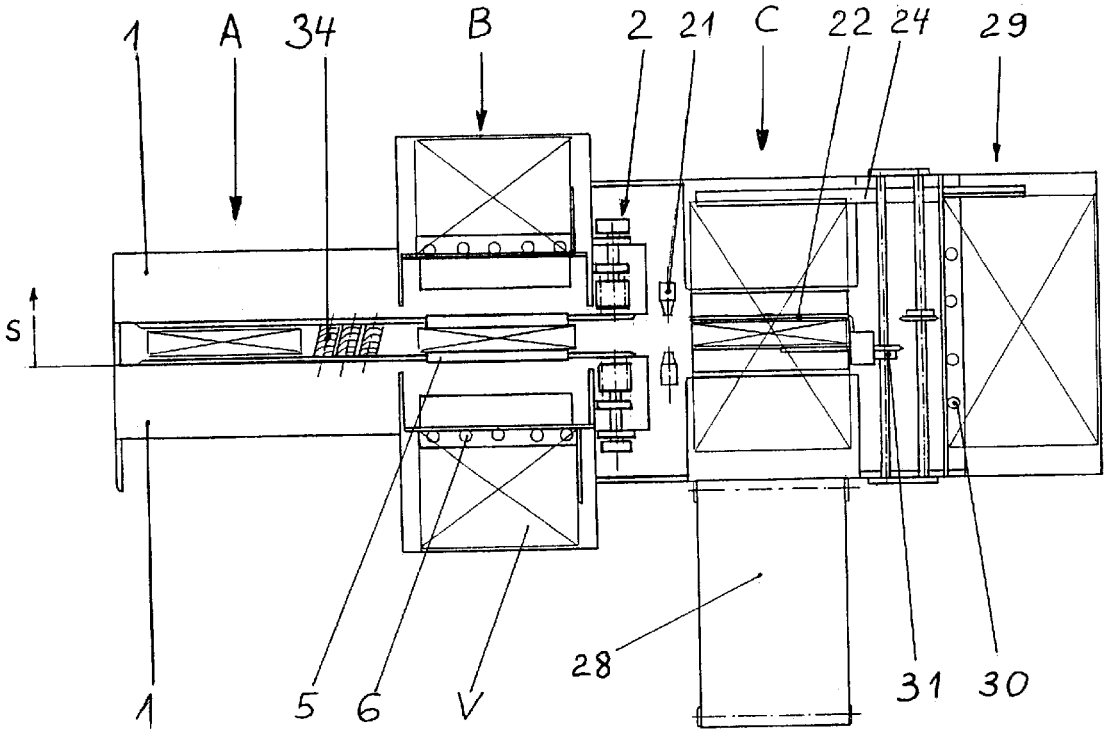
Figure 3:
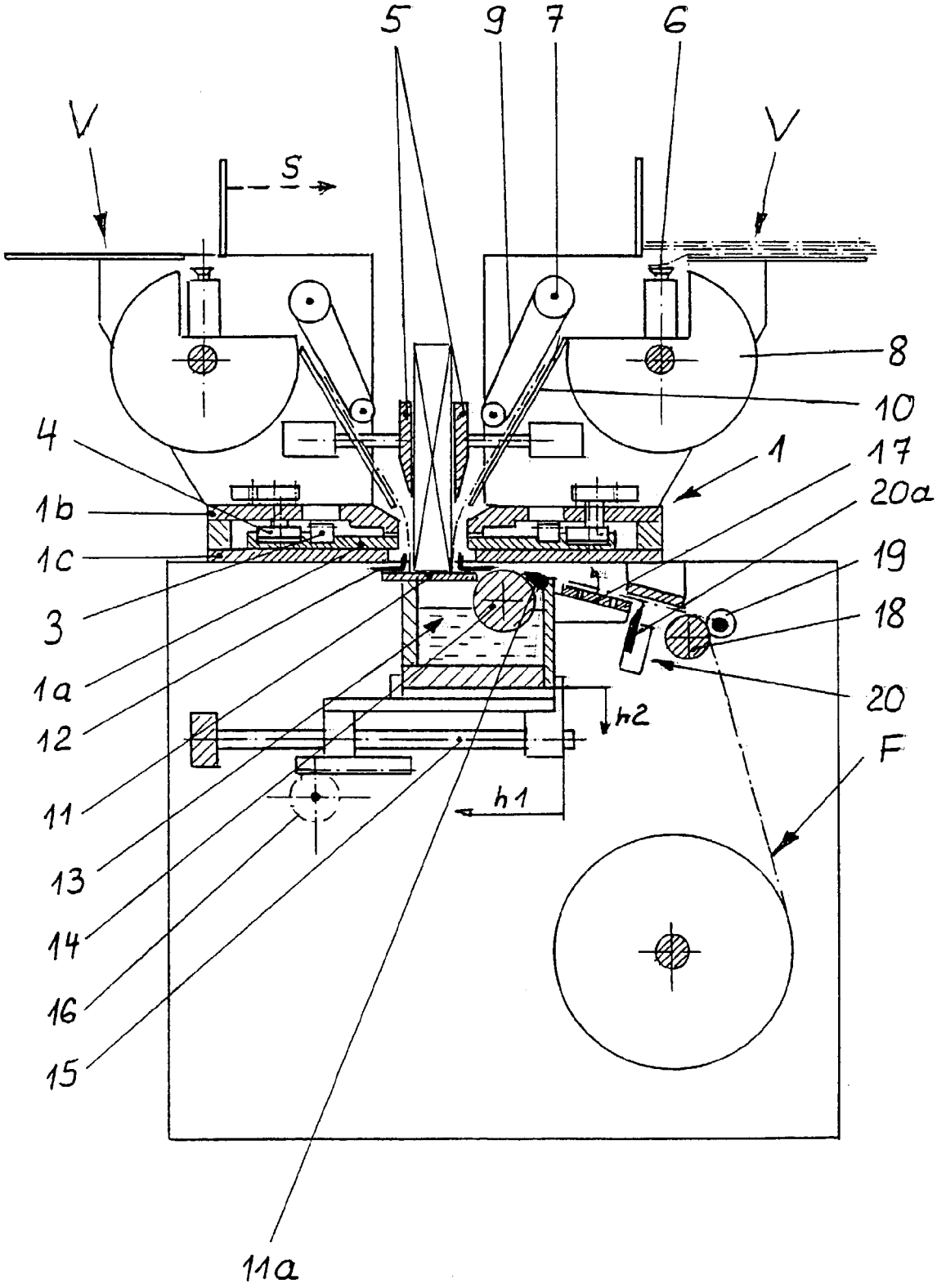
Figure 4:
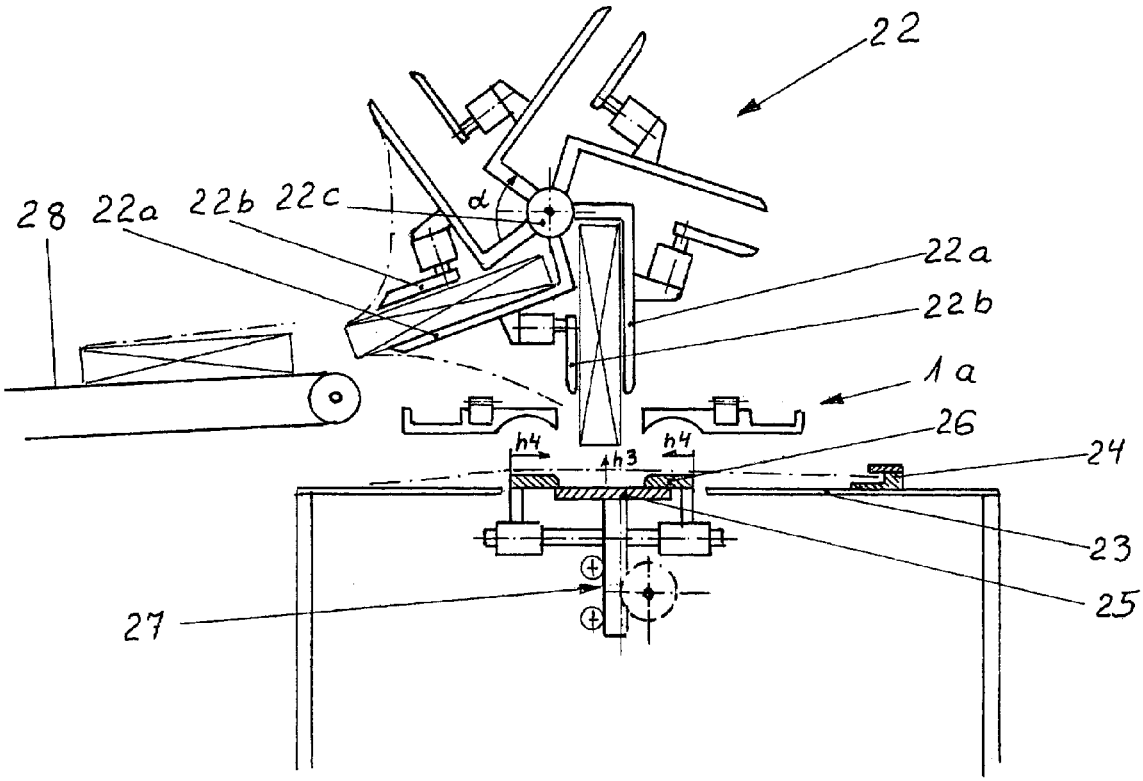

The present invention will be described below on the basis of an advantageous embodiment with reference to the attached drawings. In the drawings, FIG. 1 shows a side view of the device according to the present invention, FIG. 2 shows a top view of the device according to the present invention, FIG. 3 shows a section through the end paper placing, slip-fold strip feeding and gluing station, and FIG. 4 shows a section through the pressing station and the delivery device.

The stepwise conveying of the individual block is carried out by the conveying device 1 with the clamping rails 1*a* running to and fro, the upper guide 1*b* and the lower guide 1*c*. The stroke of the conveying device is always generated via toothed rack drives 2, which engage a toothed rack 3 on the clamping rails 1*a*.

The clamping stroke of the clamping rails 1*a* is generated by eccentric rollers 4.

The conveying movements take place on both sides of the block absolutely synchronously. For adaptation to the thickness of the format, one of the two lateral clamping rails 1*a*, especially the one on the right-hand side in the top view, is adjusted when viewed in the direction of conveying, which is illustrated by the path of adjustment in the representations.

In the simplest design of the feed, the blocks are placed manually in the intake position A. The insertion may be carried out with the forward stroke and return stroke running as soon as the previous block has left the position.

On the way from position A to position B, the block passes over a processing unit to prepare a straight block spine, the milling means 34 in this exemplary embodiment. To save space, the processing tools for milling, equalizing and notching have a roller-shaped design.

The block is taken over in position B by the holding clamps 5 of a separate holding device before the clamping rails 1*a* are released and return.

An end paper V is separated by a suction bar 6 during the conveying movement and conveyed further by means of a roller 7, which runs against a drum 8, and the belt 9, and the said end paper is guided by a plate 10.

The end paper with its back reaches the level of the spine of the block in a time-coordinated manner when the clamping rails 1*a* have opened. The end paper is positioned by the plate 11 on both sides of the block exactly at the level of the spine and held by the auxiliary clamps 12, which can be actuated, e.g., by pneumatic auxiliary means, not shown.

The aligning plate 11 belongs to the gluing station and forms the cover and the scraper of a gluing mechanism, which is designated by 13 in its entirety. The gluing mechanism 13 with a gluing roller 14 is moved through under the spine of the block (stroke h1) along a guide 15 by a drive 16, while the gluing roller 14 performs a synchronous rotary movement, so that its surface rolls against the spine of the block and transfers the glue. The thickness of the glue film is set by displacing the plate 11 (scraper). The application and removal of the glue film at the head and foot can be achieved by scraping off the gluing roller in the corresponding areas by means of narrow scrapers, not shown, which can be displaced along the length of the gluing roller.

The glue pan can be heated for processing hot melt adhesives.

The gluing mechanism 13 is lowered somewhat downward during its return stroke to prevent any contact from becoming established with the spine that was meanwhile folded (stroke h2). The scraper 11 is released when the gluing roller is rotating backward during the return stroke. Contamination with glue on the scraper is now flushed off automatically.

If no folding slip-fold strip is fed, the gluing roller 14 can apply another, e.g., thicker glue film during the return stroke. The glue film thickness is determined now by the return scrapers 11*a*, and the lowering h2 takes place until the correct distance becomes established between the roller and the spine of the block.

A suction plate 17, which takes up the slip-fold strip cut to the desired length and presses it to the spine of the block at the end of the gluing stroke h1, is arranged pivotably at the glue pan.

Arriving from the roll, the folding material F is fed by a roller 18 with counterrollers 19 to the cutting means 20 with the knife 20*a* by means of simple drive means, not shown, and the conveying stroke corresponds to the length to be cut off. The suction plate 17 holds the slipfold strip when the cut is taking place.

The block, which is glued on the spine and is provided with end papers and slip-fold strips, is again clamped by the clamping rails 1*a* in position B and conveyed into position C. The belt 9 is now released by means of a simple actuating means, not shown. This second area of the clamping rails is designed such that the block will have a greater overhang so that the side gluing can take place during the stroke from B to C. It is preferably carried out by means of prior-art nozzle-type application means 21.

The block is taken up in position C by a clamping station of the star-shaped delivery unit 22, which clamping station is standing ready, and clamped by the stationary clamp side 22*a* and the movable clamp side 22*b*.

The cover lying ready on the table 23 is aligned by a guide 24 and stops, not shown, and is pressed onto the spine of the block by a pressing table 25 and pressing rails 26. The pressing table 25 performs a vertical movement h3 for this purpose, driven by a toothed rack drive 27.

After the clamping rails 1*a* have left the area during the return stroke, the lateral pressing is performed by the pressing rails 26 with the stroke h4.

The pressing rails 26 and the pressing table 25 return, and the block is brought into a position slightly inclined in relation to the horizontal direction by pivoting the star-shaped delivery unit 22 by one pitch a around the axis of rotation 22*c*. To obtain the desired slope angle, the star-shaped delivery unit is divided into five parts. The clamp 22*b* opens and the block slides on the sloped surface of the clamp 22*a* onto a delivery belt 28.

In another embodiment, not shown here, the block may also be pushed from the clamp 22 onto the conveyor 28. The star-shaped delivery unit is divided into four in this case and the direction of delivery is exactly horizontal.

Separated by suction units 30, the covers are fed to scoring rollers in the known manner in a feeder 29 and conveyed further into position C, where the aligning of the cover is carried out.

What is claimed is:

1. A device for preparing adhesive bindings of blocks and brochures in an optimally utilized space, said device comprising:

a conveying device provided with a set of clamping rails for fixing a block or a brochure for moving said block or a stack of papers to be bound through the device, said clamping rails having a pick-up, and a return positions;

a processing unit for preparing a straight block spine;

a pair of feed units for adding end papers to be placed on a front side and a back side of said block or stack of papers, each of said pair of feed units arranged adjacent to and on either side of said processing unit and operates in a direction perpendicular to a conveying direction, each said feed unit further comprising a storage unit for holding a stack of end papers, an end paper separation unit for sucking a lowermost sheet from said stack of end papers, and a pull-off roller-belt transportation unit for pulling, transporting and dropping said lowermost sheet onto an exact end position of said aligning plate to flush align a lower edge of each of two said lowermost sheet with a right and a left lower spine edges of said block or stack of papers;

a gluing station for applying glue to said spine of said block or stack of papers; and a delivery device for removing a completely glued said block or stack of papers, wherein said conveying device has a separate holding means for fixing said block or stack of papers being processed in said gluing station during said return of said clamping rails into a pick-up position for a new block or stack of papers.

2. The device for preparing adhesive bindings of blocks and brochures in accordance with claim 1, wherein said holding means has at least two holding clamps that clamp a front and a rear flat sides of said block or stack of papers in their upper area facing away from said adjacent block spine.

3. The device for preparing adhesive bindings of blocks and brochures in accordance with claim 1, wherein said gluing station has a gluing mechanism movable at right angles to said direction of conveying with at least one gluing roller, wherein said gluing roller is driven by a transverse movement of said gluing mechanism, so that said gluing roller rolls on said spine of said block, and wherein a thickness of a glue film can be set by setting a scraper extending over an entire length of said gluing roller.

4. The device for preparing adhesive bindings of blocks and brochures in accordance with claim 3, wherein said gluing roller has, adjustably over its length, two scrapers, which scrape free said roller surface in an area for a head and a foot of said block.

5. The device for preparing adhesive bindings of blocks and brochures in accordance with claim 1, said device further comprising:

a feed station for slip-fold strips with a cutting means and a suction table associated with said gluing station, wherein said slip-fold strips are cut to a desired length at said feed station and said slip-fold strips are subsequently fed to said suction table, which is brought into a position under said spine of said block after said gluing operation and a vertical pressing unit presses said slip-fold strip to said glued block spine by a lifting movement.

6. The device for preparing adhesive bindings of blocks and brochures in accordance with claim 1, wherein said delivery device has a delivery unit with a set of clamping stations, which are arranged in a star-shaped pattern and take over said block from a longitudinal conveying and lay said block down into a clamped state after pressing on a cover or a slip-fold strip.

7. The device for preparing adhesive bindings of blocks and brochures in accordance with claim 1, wherein said clamping rails of said conveying device have at least two areas of different shapes arranged one after another in said direction of conveying, wherein said areas have an overhang adapted to a different condition of said processing stations.

8. The device for preparing adhesive bindings of blocks and brochures in accordance with claim 1, wherein said processing unit is designed as a milling station to prepare a straight block spine, and a milling is carried out with a set of roller-shaped tools.

9. A process for preparing adhesive bindings of blocks and brochures in an optimally utilized space with a device, in which a block or a brochure is guided through the device by means of a conveying device provided with clamping rails for fixing said block or brochure, wherein a straight block spine is first prepared in a processing unit, a front end paper and a rear end paper are each separated from a stack of papers placed on either side of said conveying device, and said end papers are transported in a direction perpendicular to a direction of said conveying device and dropped onto an aligning plate to merge onto the front and rear sides of said block, a spine edge of said end papers aligned flush with a spine edge of said block, after which glue is applied to said spine of said block or brochure in a gluing station by gluing, and after a completion of said gluing, a completely glued said block or stack of papers is discharged, wherein a conveying through the device takes place in at least two steps by a forward and return movement of said clamping rails clamping the block laterally on a left side and a right side when viewed in said direction of conveying, the block is taken over by a separate holding means during a return conveying stroke of said clamping rails and pass through a conveying stop phase, during which said gluing on said spine of said block takes place, and that processing operations are carried out on said block both during said movement and during a stop.

10. The process for preparing adhesive bindings of blocks and brochures in accordance with claim 9, wherein said gluing of said spine of said block is carried out by a gluing mechanism movable at right angles to said direction of conveying with at least one gluing roller, wherein said gluing roller is driven by a transverse movement of said gluing mechanism, so that it rolls on said spine of said block, and that a glue film thickness is set on a whole by a setting of a scraper extending over an entire length of said roller.

11. The process for preparing adhesive bindings of blocks and brochures in accordance with claim 10, wherein a double glue application can be carried out by a twofold transverse lifting movement of said gluing roller, and said thickness of said glue film can be varied from one stroke to a next stroke by adjusting said scraper.

12. The process for preparing adhesive bindings of blocks and brochures in accordance with claim 10, wherein said glue is applied twice, by at least one layer of a thin film and a thick film, by two rollers arranged one after another in said direction of said gluing stroke with at least two different scraper settings.

13. The process for preparing adhesive bindings of blocks and brochures in accordance with claim 9, wherein a roll of slip-fold strips are cut to a desired length during said gluing operation and are subsequently fed to a suction table, which is brought into a position under said spine of said block with a gluing movement and presses said slip-fold strip onto a glued block spine by a lifting movement.

14. The process for preparing adhesive bindings of blocks and brochures in accordance with claim 9, wherein said block is delivered by means of a delivery device by a delivery unit with a set of clamps arranged in a star-shaped pattern, said set of clamps take over said block from a longitudinal conveying and put it down in said clamped state after a cover or a slip-fold strip has been pressed on.

15. The process for preparing adhesive bindings of blocks and brochures in accordance with claim 9, wherein a pair of covers are fed to said block from a direction that is opposite said direction in which said block is conveyed.

16. The process for preparing adhesive bindings of blocks and brochures in accordance with claim 9, wherein when the device is operated without said feed of slip-fold strips, two glue applications with different film thicknesses can be performed during a gluing forward stroke and a gluing return stroke, and said glue film thickness is determined by a forward scraper and a return scraper, and a lowering of said gluing mechanism during said return stroke is adapted to said thickness of said glue film applied.

17. A compact binding device comprising:

a block conveyer with two opposite clamping rail means for clamping a block, said clamping rail means movable alongside said block conveyer in a conveying direction, wherein said clamping rail means secures an upright block with a spine side facing downward at an intake position and mobilizes said block to top of an aligning plate;

an underneath roller-shaped spine-preparing unit adjacent said intake position;

an end paper applying unit positioned to operate perpendicular to said conveying direction adjacent said aligning plate, said end paper applying machinery further comprising a stack of end papers, a separation means that separates one of said stack of end papers, a guiding means that moves and drops said one separated end paper on said aligning plate, positioning said one separated end paper in a flush position with said block adjacent to said block and merges said one separated end paper flush aligned with said block;

an underneath gluing station under said aligning plate;

a side gluing mechanism at a distance away from said gluing station, for glueing a strip of a side adjoining said spine side as said block is moved along said block conveyor;

a cover applying and conveying station located at a distance away from said underneath gluing station.

18. A compact binding device according to claim 17, wherein said underneath gluing station further comprises:

a gluing roller extending in said conveying direction alongside an edge of said aligning plate, rotatable about an axis parallel to said conveying direction, said gluing roller partly submerged in a vat of glue;

a glue thickness adjusting means situated lengthwise along said gluing roller, placed away from said aligning plate edge, said gluing station movable transversely and vertically in a direction perpendicular to said conveying direction, wherein said gluing station moves transversely to move said aligning plate away from said spine side, rotating said gluing roller to glue said spine side, and said gluing station moves lower and moves in reverse of said transverse direction to prevent any further contact between said gluing station and said spine side, and to release and flush off any glue contamination from said aligning plate.

19. A compact binding device according to claim 17, wherein said spine preparing unit further comprises of at least one of a milling, equalizing, and notching machinery, said spine preparing unit prepares said spine side by at least milling, equalizing, and notching said spine side at said intake position.

20. A compact binding device according to claim 17, wherein said cover applying and conveying station further comprises a supply of covers, a cover guiding means for delivering a cover to said block, a vertically movable pressing table and a set of side-pressing rails that press said cover into said spine, and a rotary delivery mechanism with a plurality of delivery arms, each delivery arm having a movable clamp side and a stationary clamp side, wherein said stationary clamp side takes up said block, and said delivery arm is rotated to pivot said stationary clamp side and as said block is brought into a defined position, said movable clamp opens and said block slides onto a delivery belt.

* * * * *